United States Patent [19]

Imamura et al.

[11] 4,363,692

[45] Dec. 14, 1982

[54] SHEET BINDING APPARATUS

[75] Inventors: Yoshiyuki Imamura; Moriatsu Kawakami, both of Tokyo, Japan

[73] Assignee: Laurel Bank Machine Co., Ltd., Tokyo, Japan

[21] Appl. No.: 249,720

[22] Filed: Mar. 31, 1981

[30] Foreign Application Priority Data

Apr. 30, 1980 [JP] Japan ..... 55-57575
Apr. 30, 1980 [JP] Japan ..... 55-57576

[51] Int. Cl.[3] ..... B32B 31/20

[52] U.S. Cl. ..... 156/351; 156/366; 156/367; 156/502; 156/515; 156/522

[58] Field of Search ..... 156/350, 351, 366, 367, 156/502, 507, 515, 522; 53/528, 548, 586; 100/3, 6, 24, 17, 18, 33 PB; 242/55, 59, 75.4, 75.43, 75.44, 156, 156.2

[56] References Cited

U.S. PATENT DOCUMENTS

| | | | |
|---|---|---|---|
| 3,670,986 | 6/1972 | Farkas | 242/75.4 |
| 3,866,851 | 2/1975 | Brooks | 242/75.43 |
| 3,946,539 | 3/1976 | Noack | 53/586 |
| 4,099,601 | 7/1978 | Pittman | 242/156.2 |
| 4,250,692 | 2/1981 | Uchida | 53/528 |

*Primary Examiner*—Caleb Weston
*Attorney, Agent, or Firm*—Fleit & Jacobson

[57] ABSTRACT

Herein disclosed is a sheet binding apparatus wherein sheets such as bank notes are wound by tape and bound into a bundle of sheets by fusing and cutting the tape. The apparatus is provided with a pair of holding plates, each formed with a notch groove through which the tape is passed. The holding plates which hold the sheets therebetween are horizontally moved to a binding section while a tape is passed through one of the notch groove of one holding plate. At the binding section, a tape push-down member pushes down the tape through the other notch groove of the other holding plate to wind the sheets. The tape push-down member is formed at the lower end thereof with a forked portion for providing a recess. A heating member having a convex surface for engaging with the tape is disposed below the recess of the tape push-down member. The tape is heated and cut off while it is sandwiched between the tape push-down member and the heating member. A tension imparting mechanism is provided for imparting a tension to the tape. A plurality of position detecting sensors are provided for detecting the various positions of the tape push-down member and issuing signals for commanding various operations.

15 Claims, 5 Drawing Figures

SHEET BINDING APPARATUS

BACKGROUND OF THE INVENTION

1. Field of the Invention

This invention relates to a sheet binding apparatus for binding sheets such as bank notes by the tape.

2. Prior Art

In a sheet binding apparatus various kinds of sheets must be handled and the conditions under which the sheets are wound vary with the differences in the size and thickness of the sheets. Therefore, the conventional sheet binding apparatus must be provided with compensating devices for adjusting to various conditions. Consequently, the conventional sheet binding apparatus is complicated in construction. In order to eliminate such disadvantages, the sheet binding apparatus disclosed in Japanese patent application No. 86501/1977 has been proposed. This apparatus has no compensating device is therefore simple in construction but can nevertheless accommodate sheets of various sizes and thicknesses. However, in the apparatus, there are problems in that adhesion and cutting of the tape cannot be carried out sufficiently and control of various operations cannot be accomplished without fail.

SUMMARY OF THE INVENTION

It is, therefore, a object of the present invention to provide a sheet binding apparatus which eliminates the above-mentioned disadvantages.

Another object of the present invention is to provide a sheet binding apparatus of the type mentioned above which can perform accurate adhesion and cutting of the tape by which the sheets are bound.

A further object of the present invention is to provide a sheet binding apparatus of the above type which can control various operations for binding the sheets without fail.

According to the present invention, there is provided an apparatus for binding sheets by a tape which comprises: a supporting plate for supporting thereon sheets to be bound; a pair of confronting holding plates disposed above the supporting plate and horizontally movable between one position where the sheets are set between said holding plates and another position where the sheets are bound, each holding plate being formed on the inner surface thereof with a notch groove; means for supplying the tape to said holding plates; means for horizontally moving the holding plates to clamp the sheets therebetween while the tape is received in one notch groove of one holding plate between said one holding plate and the sheets to cover the sheets at top and bottom edges thereof with the tape; a tape push-down member disposed above the pair of holding plates and movable vertically to push the tape into the groove of the other holding plate between said other holding plate and the sheets whereby the sheets are wrapped with the tape, the tape push-down member being formed at its lower end with a forked portion in which a recess is formed; and a heating member for bonding wrapping ends of the tape and cutting the tape to separate a wrapping end of the tape from a supplied end of the tape, the heating member being disposed below the recess of the tape push-down member and having a convex surface for engaging with the tape to bond and cut the tape.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will be now described in detail with reference to the accompanying drawings.

Figure 1:
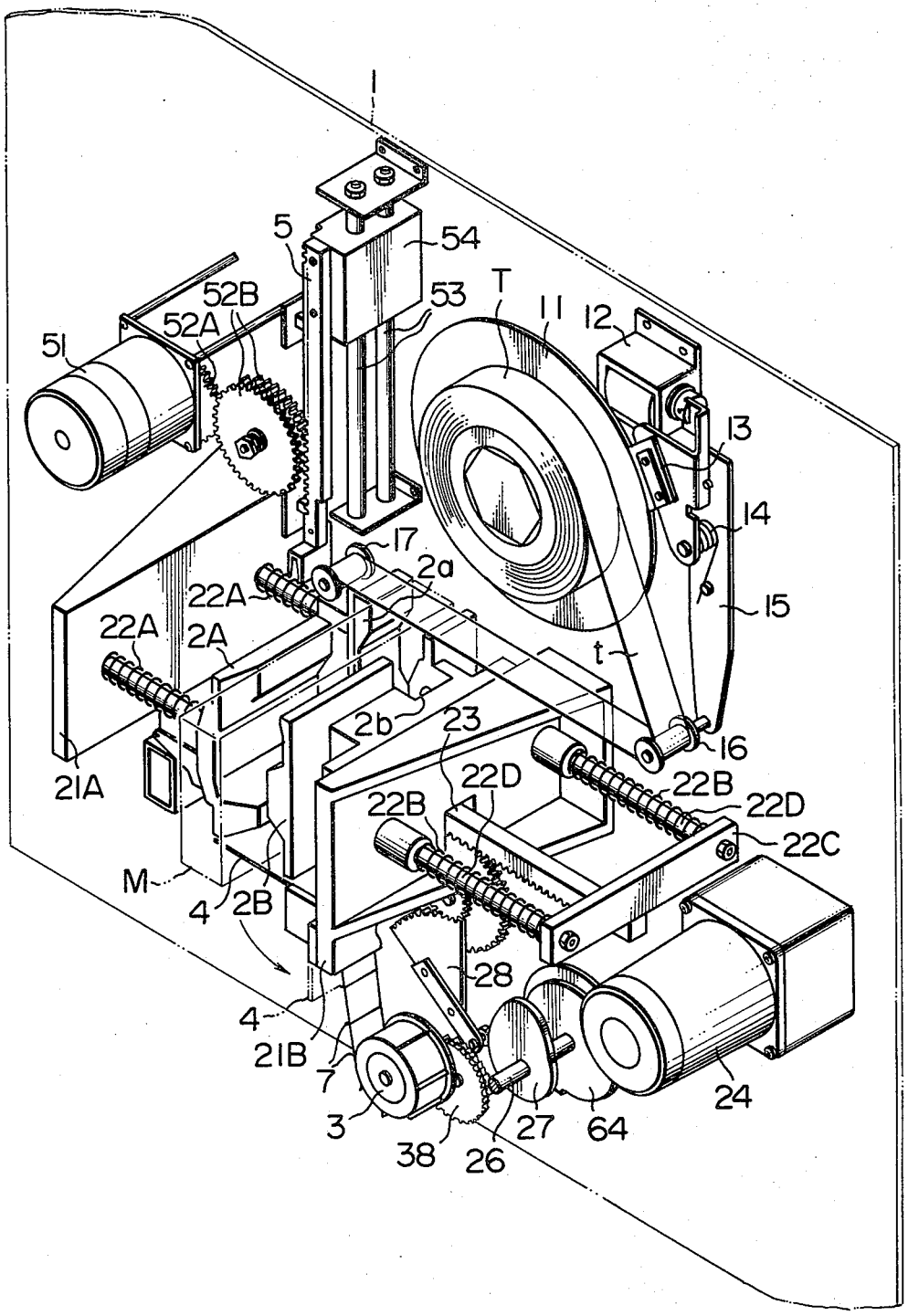
FIG. 1 is a perspective view showing the overall construction of a sheet binding apparatus according to the present invention.
Figure 3:
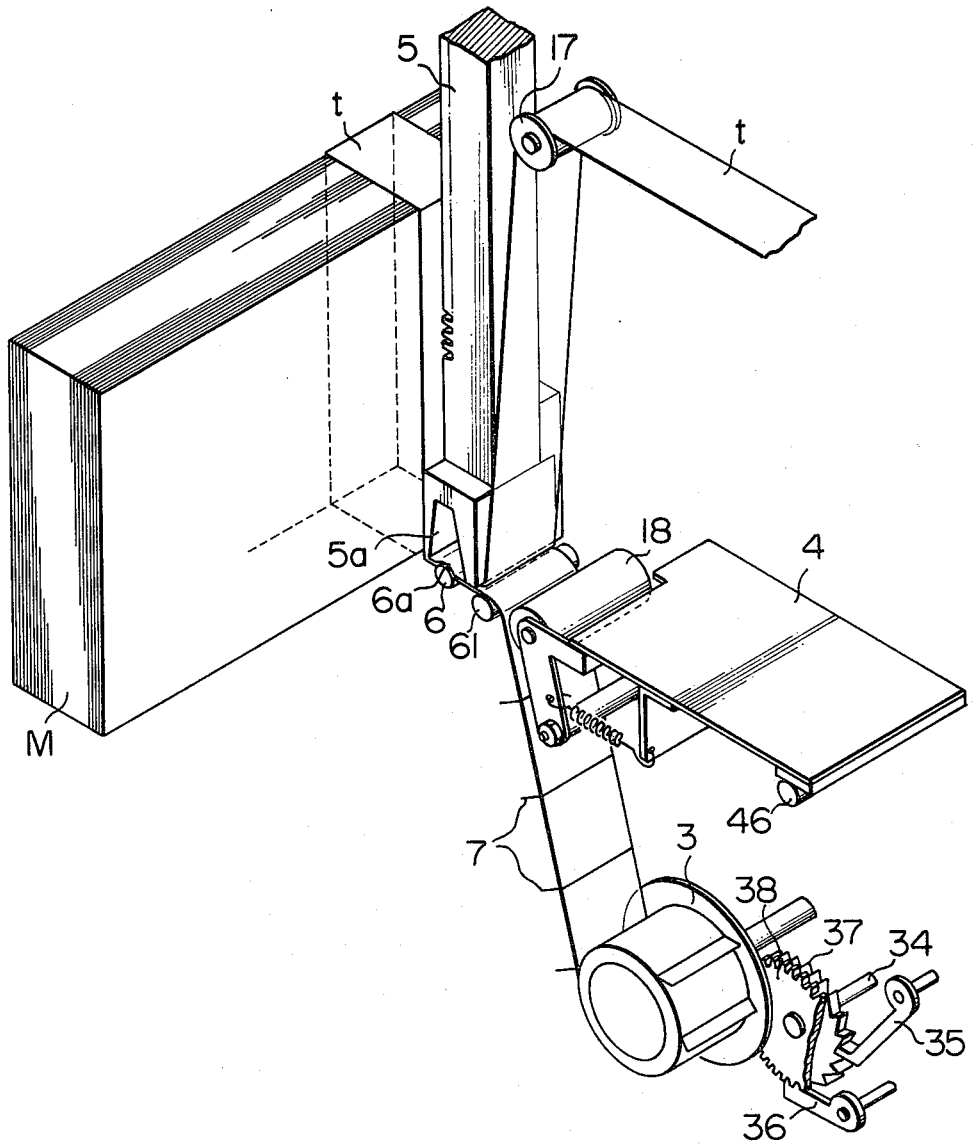
FIG. 3 is a perspective view showing a tape by which a bundle of paper sheets is wound.

The general winding operation of the sheet binding apparatus will be first described mainly with reference to FIGS. 1 and 3. A tape coil T made of a heat-adhesive material such as polyvinyl-chloride is rotatably mounted on a frame 1. A tape t which is pulled out from the tape coil T is passed on a tension roller 16 and a guide roller 17, then through a notch groove 2*a* of a holding plate 2A, and finally wound up on a take-up head 3 so that the tape t is maintained under tension. Paper sheets M such as a bundle of bank notes are disposed on a supporting plate 4 and then are sandwiched between two holding plates 2A and 2B by moving the holding plate 2B toward the holding plate 2A. An adhesion and cutting member 6, hereinafter referred to as a heating member, is raised to be engaged with the tape t. In such a state, a tape push-down member 5 which is disposed above the heating member 6 is lowered long a notch groove 2*b* of the holding plate 2B so as to wind the sheets M with the tape t while imparting tension to the tape t. Consequently, at the lower corner of the sheets M, a portion of the tape is overlapped on another portion thereof. At the time, the heating member 6 heats the overlapped portions of the tape to fuse and integrally adhere them and simultaneously the tape is cut off intermediate of the adhered portion. Thereafteer, the tape push-down member 5 and the heating member 6 are returned to their initial positions, respectively, and then, the holding plates 2A and 2B are opened to discharge the sheets thus bound. At the same time, the take-up head 3 is rotated a bit to wind up a residual adhered tag 7. Thus, the sheet binding apparatus is now ready for the next cycle of operation.

The construction of the sheet binding apparatus will be now described in more detail. In FIG. 1, the tape coil T is mounted on a tape head 11 rotatably mounted on the frame 1. The tape head 11 is adapted to be engaged with a brake member 13 which is actuated by a solenoid 12 secured on the frame 1, thereby braking the tape head 11, when necessary. Provided adjacent the brake member 13 is a tension plate 15 which is outwardly urged by a coil spring 14 and is provided at its lower end with a tension roller 16. Thus, the tension roller 16 imparts tension to the tape t while the tape t is passed on the tension roller 16. The tape t pulled out from the tape coil T is passed on the tension roller 16, a guide roller 17 secured on the frame 1 above the notch groove 2*a* of the holding plate 2A, and on a lower roller 18 is disposed below the notch groove 2*a* onto the take-up head 3 (see FIGS. 1 and 3).

A pair of guide frames 21A and 21B are secured on the frame 1 opposite to each other, between which the holding plate 2A and 2B are disposed opposite to each other. The holding plate 2A is constructed to be movable relative to the guide frame 21A and is normally urged by springs 22A toward the other holding plate 21B, so that a portion of the tape t extended between the guide roller 17 and the take-up head 3 is fitted in the notch groove 2*a*. In a similar manner, the other holding plate 2B is constructed to be movable relative to the guide frame 21B and is normally urged by springs 22B towards the holding frame 2A. The springs 22B are mounted on guide shafts 22D between the guide frame 22B and a connecting plate 22C connected thereto through the guide shafts 22D.

Figure 2:
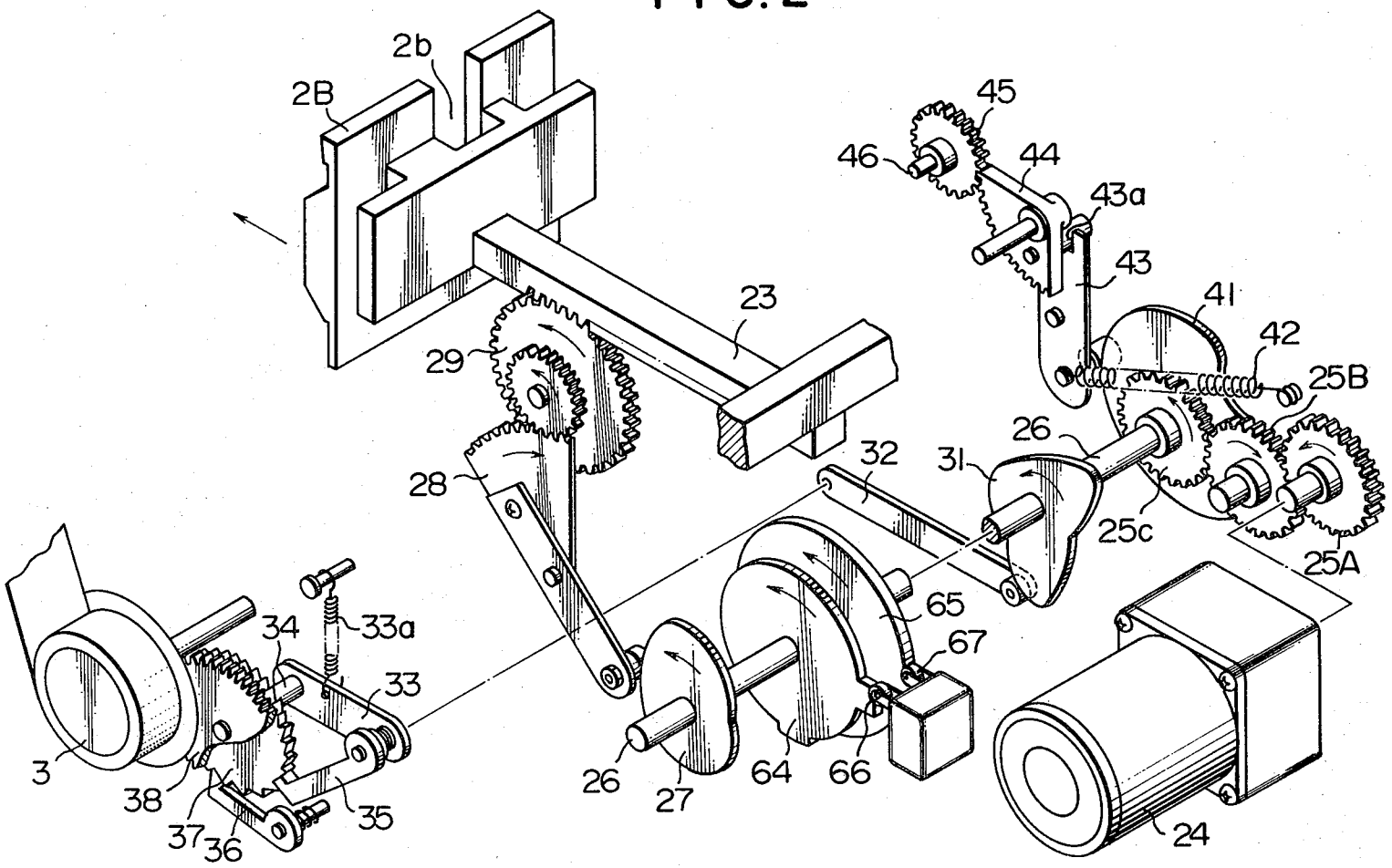
FIG. 2 is an exploded perspective view showing a portion of a driving mechanism used in the sheet binding apparatus.

In FIG. 2, a rack member 23 is secured to the holding plate 2B and is driven in a linear movement by a driving motor 24 through gears 25A, 25B and 25C, a cam shaft 26, a cam 27, a sector gear 28 and a pinion 29, which will be described in more detail.

The gear 25A which is directly rotated by the motor 24 is engaged with the gear 25B which in turn is engaged with the gear 25C. The cam shaft 26 of the gear 25C is provided with the cam 27 at the end opposite to the other end at which the gear 25C is secured. The cam 27 drives a cam follower secured to the sector 28 which in turn rotates the gear 29 through a gear engaged with the sector 28. The gear 29 is engaged with the rack to drive the same in a linear movement.

In the above construction, when the motor 24 drives the gear 25A, the holding plate 2B is caused to move toward the holding plate 2A against the action of the springs 22B.

The take-up head 3 is adapted to be driven by the motor 24 through the gears 25A, 25B and 25C, the cam shaft 26, a cam 31, a lever 32, a feed pawl 35, a ratchet wheel 37 and a gear 38. More particularly, the arm 32 is rigidly connected to an arm 33 which is pivotably mounted on a shaft 34. The shaft 34 is urged by a spring 33*a*. The feed pawl 35 is rigidly connected to the arm 33 and is engaged with the ratchet wheel 37 so as to drive the same to be rotated about the shaft 34. A stop pawl 36 is also engaged with the ratchet wheel 37 so as to prevent the same from rotating reversely when the feed pawl 35 idly slides on the teeth of the ratchet wheel 37 backwardly. The gear 38 is rigidly connected to the shaft 34 adjacent the ratched wheel 37 and is adapted to drive the take-up head 3.

In the above construction, when the motor 24 drives the gear 25A, the take-up head 3 is intermittently rotated to take up the tape t a predetermined amount.

The support plate 4 is also driven by the motor 24. More particularly, a cam 41 is secured on the cam shaft 26 adjacent the gear 25C and is engaged with a lever 43 through a cam follower or roll rotatably attached thereto by the action of a spring 42. The lever 43 is engaged with a sector gear 44 through a notch 43*a* of the lever 43 and a rod attached to the sector gear 44. The gear 44 is engaged with a gear 45, a shaft 46 of which is secured to the support plate 4 (see FIGS. 2 and 3).

In the above construction, when the motor 24 drives the gear 25A, the support plate 4 is swung about the shaft 46 between a horizontal position as shown in FIG. 3 and an inclined position where a roller 18 attached to the support plate 4 is lowered.

Figure 4:
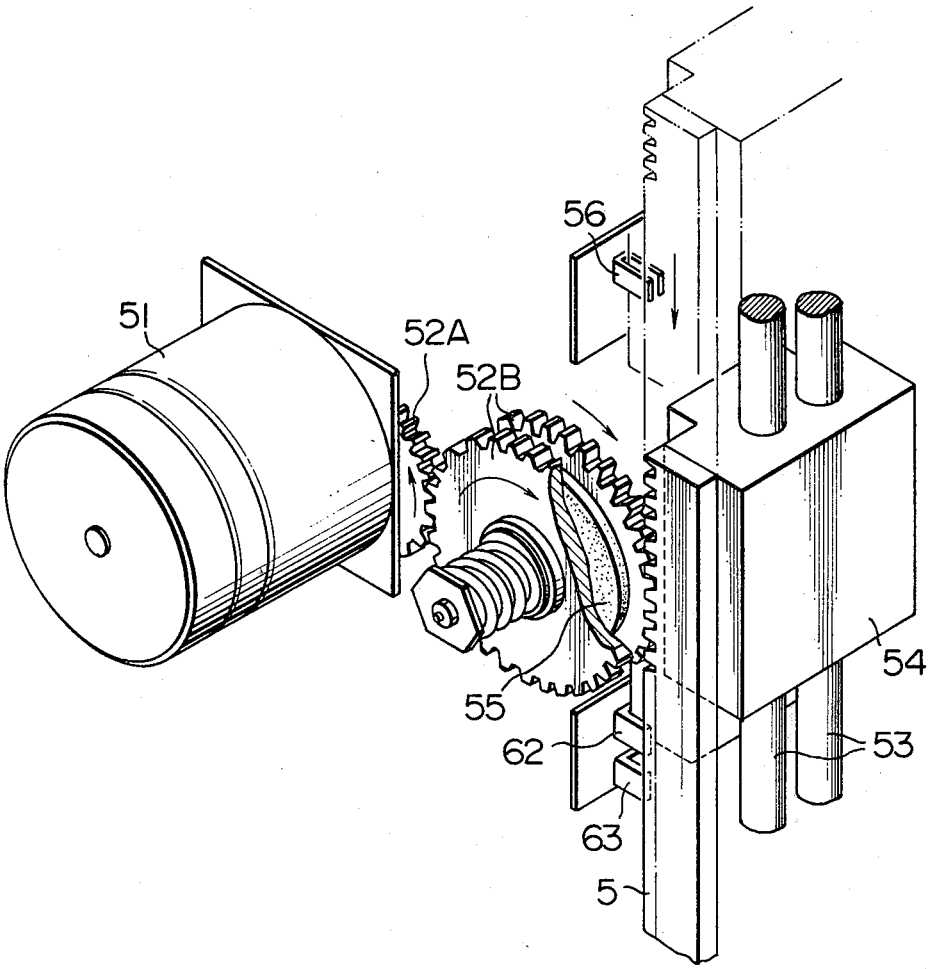
FIG. 4 is a perspective view showing a tape winding mechanism used in the sheet binding apparatus.

In FIG. 4, the tape push-down member 5 is mounted on a carriage 54 which is movable on guide shafts 53 secured to the frame 1. The tape push-down member 5 is driven by a motor 51 through a gear 52A and a pair of gears 52B to move in the vertical direction. One of the gears 52B is engaged with the gears 52A and the other is engaged with a rack-shaped portion of the tape push-down member 5. A friction plate 55 is frictionally clamped between the gears 52B. When a rotational torque transmitted from one of the gears 52B to the other becomes greater than a predetermined value, as in a case which will be described later, upon downward movement of the tape push-down member 5, the friction plate 55 functions to cause a slippage between the gears 52B so as to prevent a rotation torque from transmitting from one of the gears to the other.

A first position detecting sensor 56 is provided in a suitable position facing the tape push-down member 5 for detecting a position where the tape push-down member is raised and issuing a signal for stopping the same.

In FIG. 3, the above-mentioned heating member 6 is made in the rod-shaped form and, therefore has a convex surface 6*a* at its upper side. The tape push-down member 5 is formed at the lower end thereof with a forked portion in which a recess 5*a* is formed. When the heating member 6 is adapted to be movable in a vertical direction by solenoids, not shown, so as to move toward and away from the recess 5*a*. As will be described in more detail later, after the sheets are wound by the tape, the heating member 6 is adapted to be heated so as to heat the tape.

Furthermore, a turn roller 61 is provided between the heating member 6 in the uppermost position, as shown in FIG. 3 and the lower roller 18 for introducing the tape between the rollers 61 and 18 onto the take-up head 3.

Furthermore, a second position detecting sensor 62 is provided facing the tape push-down member 5 for detecting the lower position of the tape push-down member 5 when the recess 5*a* comes near the heating member 6, as shown in FIG. 3. A third position detecting sensor 63 is also provided adjacent the second sensor 62 for detecting the lowermost position of the tape push-down member 5 below the above-mentioned lower position.

Furthermore, cam plates 64 and 65 are connected to the cam shaft 26 driven by the motor 24 and microswitches 66 and 67 are provided adjacent the cam plates 64 and 65 so as to be actuated by the cam plates 64 and 65, respectively.

Figure 5:
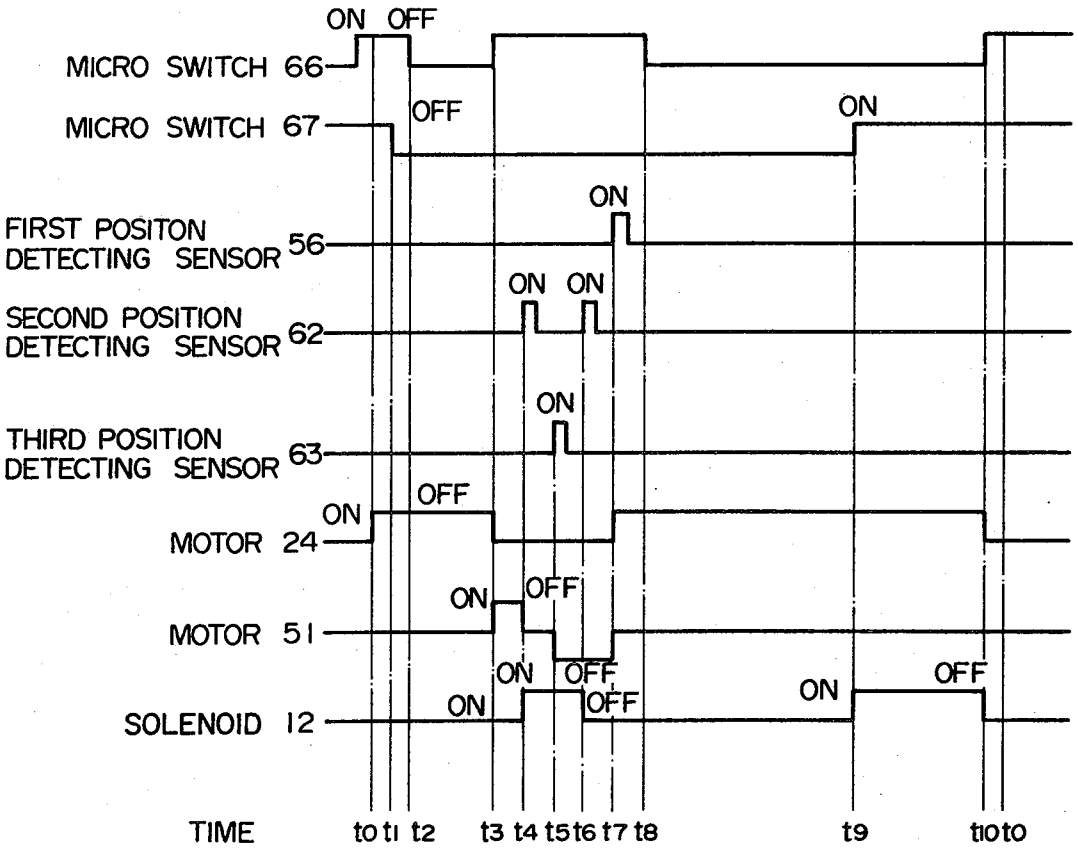
FIG. 5 is a time chart showing the operational timing of various main operating members used in the sheet binding apparatus.

The operation of the sheet binding apparatus will be now described particularly with reference to FIG. 5. FIGS. 1 and 2 show the condition at the time $t_o$ of FIG. 5 before the sheet binding apparatus starts its binding operation. At this time, the holding plates 2A and 2B are positioned in a spaced relationship above the supporting plate 4 which is maintained horizontal. The tape head 11 is released from the braking member 13. The tape t is mounted on the tape head 11, passed on the rollers 16 and 17, through the notch groove 2*a* of the holding plate 2A and on the lower roller 18, and wound on the take-up head 3. The portion of the tape t positioned between the guide roller 17 and the lower roller 18 is maintained to be tensioned by the action of the tension roller 16. The tape push-down member 5 is in a raised position and the heating member 6 is in a lowered position, ready for binding operation.

At the time "$t_0$", the sheets M are inserted between the holding plates 2A and 2B, and supported on the supporting plate 4. When a command for binding the sheets by the tape is issued, the motor 24 starts to cause the cam shaft 26 to rotate through the gears 25A, 25B and 25C, thereby rotating the cams 27, 31 and 41, and the cam plates 64 and 65, respectively in directions shown by the arrows in FIG. 2.

At the time "$t_1$", when the cam plate 65 is rotated slightly, the microswitch 67 is switched "off" as shown in FIG. 5.

At the time "$t_2$", when the cam plate 64 is rotated slightly further, the microswitch 66 is also switched "off". In the meantime, the holding plate 2B is driven by the cam 27 through the sector gear 28, the gear 29 and the rack 23 to be moved toward the guide frame 21A. Therefore, the holding plate 2B pushes the holding plate 2A through the sheets M, and both of the holding plates 2A and 2B and the sheets M clamped therebetween are brought into a position adjacent the guide frame 21B together. During the above-mentioned movements of the holding plates and the sheets, the tape t comes into contact with the sheets M first at the one side surface of the sheets M opposite the holding plate 2A and then at the upper and lower ends of the sheets M. Thereafter, the holding plates 2A and 2B are further moved by the cam 27 toward the guide frame 21A so that the notch groove **2*b* of the holding plate 2B is in alignment with the tape pushdown member 5 and the heating member 6** and is maintained in such a condition for a while.

At the time "$t_3$", the cam plate 64 causes the microswitch 66 to be switched on to issue a signal so as to stop the motor 24 and start the motor 51. When the motor 51 is started, the rotation of the motor 51 is transmitted through the gears 52A and 52B and the friction plate 55 to the tape push-down member 5 to lower the same as shown by an arrow in FIG. 4. At this time, the above-mentioned "ON" signal of the microswitch 66 causes the heating member 6 to be raised by a solenoid, not shown, so that the heating member 6 stands by in engagement with or adjacent the tape t.

At the time "$t_4$", the tape push-down member 5 downwardly pushes the tape t passing under tension between the upper end of the sheets M and the guide roller 17 to wind the sheets M by the tape t and engages the pushed portion of the tape t with the portion of the tape disposed on the heating member 6. At this time, the second position detecting sensor 62 detects the lower position of the tape push-down member 5 to stop the motor 51 and heat the heating member 6. At the same time, the solenoid 12 is energized by an "ON" signal from the detecting sensor 62 so as to actuate the braking member 13 to brake the tape head 11. The braking of the tape head 11 prevents the tape t from being pulled out of the tape head 11 and the tape push-down member 5 is, therefore, supported on the tape t above the heating member 6 as shown in FIG. 3, so that the downward movement of the tape push-down member 5 is limited. Even if the motor 51 is rotated slightly further due to inertia, the friction plate 55 is disposed between the pair of gears 52B slides therebetween and, therefore, the tape push-down member 5 is not moved downwardly and is maintained in a condition of being pushed against the tape t. By the heating of the heating member 6, the overlapped portions of the tape t within the recess **5*a* of the tape push-down member 5 are melted into an integral one. At the same time, the heating member 6 exerts maximum contact pressure on the tape at the uppermost portion of the convex surface 6*a* of the heating member 6 and, therefore, the portion of the tape upon which maximum contact pressure is exerted is heated the highest temperature to be split into two parts by fusion. Consequently, the sheets M are bound by the tape into a bundle of sheets and the portions of the tape, one of which is suspended from the guide roller 17 and the other of which leads to the take-up head 3, are partially, adhesively connected to form a tag portion 7** protruding from the tape t.

At the time "$t_5$", when the tape t is cut off, the tape push-down member 5 which has been supported on the tape t by tension of the tape is lowered due to "play" between the parts, such as between the gears 52A and 52B, even if the motor 51 is stopped. The lowering of the tape push-down member 5 causes the third position detecting sensor 63 to be switched on, and by the "ON" signal from the detecting sensor 63, the motor 51 is reversely rotated to raise the tape push-down member 5.

At the time "$t_6$", when the tape push-down member 5 is raised slightly, the second position detecting sensor 62 is again switched on. By the "ON" signal from the detecting sensor 62, the solenoid 12 is deenergized to release the braking of the tape head 11, thereby allowing the tape t to move freely.

At the time "$t_7$", when the tape push-down member 5 is raised to its initial position as shown in FIG. 1, the first position detecting sensor 56 is switched on to cause the motor 51 to stop, and to cause the motor 24 to rotate again.

At the time "$t_8$", the rotation of the motor 24 causes the cam 27 to gradually release the sector gear 28. Consequently, no force in the direction of the arrow shown in FIG. 2 is exerted on the rack member 23 connected to the sector gear 28 and, therefore, the holding plates 2A and 2B with the bound sheets M clamped therebetween are pushed by actions of the springs 22A and 22B in a direction opposite to that of arrow shown in FIG. 2 to be gradually moved to this initial positions. In the meantime, the cam plate 64 is rotated further in the direction of the arrow shown in FIG. 2 to cause the microswitch 66 to be off.

At the time "$t_9$", when the cam shaft 26 is rotated further in the direction of the arrow shown in FIG. 2, the microswitch 67 is switched on to cause the solenoid 12 to be energized to brake the tape head 11. Consequently, tension is generated in the tape t due to the pushing force of the sheets M against the tape t during the movement of the sheets M toward the guide frame 21B. The greater tension of the tape which would be generated by a further movement of the sheets M is absorbed by the rotation of the tension plate 15 against the action of the spring 14. Under such a condition, the bound sheets M clamped between the holding plates 2A and 2B are returned to a position above the supporting plate 4. At the time, the holding plate 2A is stopped in its initial position as shown in FIG. 1 by a stopper, not shown.

In the meantime, the rotation of the cam 31 causes the feed pawl 35 and the stop pawl 36 to be actuated to rotate the take-up head 3, thereby taking up the tape t slightly. Consequently, the tag portion 7 is moved slightly away from the lower roller 18 and the turn roller 61. Furthermore, after the stopping of the holding plate 24, the holding plate 2B is still moved toward the guide frame 21B by the action of the springs 22B to release the bound sheets M. Thereafter, the supporting plate 4 is rotated up to the position shown in dotted lines in FIG. 1 by the cam 41 through the lever 43, the sector gear 44, the pinion 45 and the shaft 46. Consequently, the bound sheets M are discharged into an outlet section, not shown. When the bound sheets M are discharged from the supporting plate 4, the tension of the tape is decreased. However, the decreased tension of the tape t is compensated for by the coil spring 14 through the tension plate 15 and, therefore, the tension of the tape is maintained to be the same as that before the discharge of the bound sheets M. Thereafter, the supporting plate 4 is returned to its initial position as shown in FIG. 1 by the cam 41 and the spring 42.

At the time "$t_{10}$", by a further rotation of the motor 24, the cam shaft 26 completes one revolution, thereby switching the microswitch 66 on again. The "ON" signal of the microswitch 66 causes the motor 24 to stop. At the same time, the solenoid 12 is deenergized to allow the tape t to move freely. Thereafter, the operation of the sheet binding apparatus returns to its initial condition at the time "$t_0$" and is ready for the next cycle of binding operation.

Although in the above-mentioned embodiment, the stopping of the motor 24 and the start of the motor 51 are controlled by the "ON" signal from the microswitch 66 at the time "$t_3$", the stopping of the motor 24 and the start of the motor 51 may be controlled by the "OFF" signal of the microswitch 67 at the time "$t_3$". Furthermore, the solenoid 12 for braking the tape head 11 may be energized between times "$t_3$" and "$t_7$", or may be energized by "ON" and "OFF" signals from the second position detecting sensor 62 between the times "$t_4$" and "$t_6$".

What is claimed is:

1. An apparatus for binding sheets by a tape which comprises:

a supporting plate for supporting thereon sheets to be bound;

a pair of confronting holding plates disposed above the supporting plate and horizontally movable between one position where the sheets are set between said holding plates and another position where the sheets are bound, each holding plate being formed on the inner surface thereof with a notch groove;

means for supplying the tape to said holding plates;

means for horizontally moving the holding plates to clamp the sheets therebetween while the tape is received in one notch groove of one holding plate between said one holding plate and the sheets to cover the sheets at top and bottom edges thereof with the tape;

a tape push-down member disposed above the pair of holding plates and movable vertically to push the tape into the groove of the other holding plate between said other holding plate and the sheets whereby the sheets are wrapped with the tape, the tape push-down member being formed at its lower end with a forked portion in which a recess is formed;

a heating member for bonding the ends of the wrapped tape and cutting the tape to separate the end of the wrapped tape from the supplied end of the tape, the heating member being disposed below the recess of the tape push-down member and having a convex surface for engaging with the tape to bond and cut the tape; and means for limiting the movement of said tape push-down member when said tape push-down member is engaged with the tape under tension and is imparted a great amount of reaction by the tape, said limting means comprising a friction plate and a pair of gears for frictionally engaging the friction plate therebetween, one of the gears being driven by a driving source and the other of the gears driving the tape push-down member.

2. An apparatus as set forth in claim 1, wherein said heating member vertically moves between one position where the bonding and cutting of the tape is performed and another position for stand-by.

3. An apparatus as set forth in claim 1 or claim 2, wherein said heating member is rod-shaped.

4. An apparatus as set forth in claim 1, wherein said tape supplying means comprises a tape head rotatably mounted for feeding a coiled tape positioned thereon to said holding plates.

5. An apparatus as set forth in claim 4, further including means for braking said tape head.

6. An apparatus as set forth in claim 5, wherein said braking means comprises a brake member disposed adjacent said tape head and movable to engage with said tape head and a solenoid associated with said brake member to cause the brake member to engage with said tape head.

7. An apparatus asset forth in claim 4, further including means for imparting tension to the tape between the tape head and a take-up head for taking up the tape.

8. An apparatus as set forth in claim 7, wherein said tension imparting means comprises a tension roller for passing the tape thereon, a tension plate pivotably mounted and connected at one end thereof to said tension roller and a spring associated with said tension plate to bias the tension plate in one direction.

9. An apparatus as set forth in claim 1, further including a second position detecting sensor for detecting the lower position of the tape push-down member where the tape push-down member engages with the tape under tension to issue a signal for stopping a motor for driving the tape push-down member.

10. An apparatus as set forth in claim 9 wherein said signal of the second position detecting sensor is also used for heating the heating member and actuating brake means to prevent the tape from being supplied from supplying means.

11. An apparatus as set forth in claim 1, further including a first position detecting sensor for detecting the upper position of the tape push-down member to issue a signal for stopping the tape push-down member.

12. An apparatus as set forth in claim 1, further including a third position detecting means for detecting the lowermost position of the tape push-down member to issue a signal for reversely rotating a motor for driving the tape push-down member.

13. An apparatus for binding sheets by a tape which comprises:

a supporting plate for supporting thereon sheets to be bound;

a pair of confronting holding plates disposed above the supporting plate and horizontally movable between one position where the sheets are set between said holding plates and another position where the sheets are bound, each holding plate being formed on the inner surface thereof with a notch groove;

means for supplying the tape to said holding plates;

means for horizontally moving the holding plates to clamp the sheets therebetween while the tape is received in one notch groove of one holding plate between said one holding plate and the sheets to cover the sheets at top and bottom edges thereof with the tape;

a tape push-down member disposed above the pair of holding plates and movable vertically to push the tape into the groove of the other holding plate between said other holding plate and the sheets whereby the sheets are wrapped with the tape, the tape push-down member being formed at its lower end with a forked portion in which a recess is formed;

a heating member for bonding the ends of the wrapped tape and cutting the tape to separate the end of the wrapped tape from the supplied end of the tape, the heating member being disposed below the recess of the tape push-down member and having a convex surface for engaging with the tape to bond and cut the tape; and position detecting sensor means for detecting the lower position of the tape push-down member where the tape push-down member engages with the tape under tension to issue a signal for stopping a motor for driving the tape push-down member, said signal of the position detecting sensor means being also used for heating the heating member and for actuating brake means to prevent the tape from being supplied from supplying means.

14. An apparatus as set forth in claim 13, further including a first position detecting sensor for detecting the upper position of the tape push-down member to issue a signal for stopping the tape push-down member.

15. An apparatus as set forth in claim 13, further including another position detecting means for detecting the lowermost position of the tape push-down member to issue a signal for reversely rotating a motor for driving the tape push-down member.

* * * * *